US010820074B2

(12) United States Patent
Foletta et al.

(10) Patent No.: US 10,820,074 B2
(45) Date of Patent: Oct. 27, 2020

(54) GRADIENT MICRO-ELECTRO-MECHANICAL (MEMS) MICROPHONE ASSEMBLY

(71) Applicant: Polycom, Inc., San Jose, CA (US)

(72) Inventors: Wayne Foletta, San Martin, CA (US); Tifenn Boisard, Austin, TX (US); Erwin Mariano, Chonburi (TH)

(73) Assignee: Polycom, Inc., San Jose, CA (US)

( * ) Notice: Subject to any disclaimer, the term of this patent is extended or adjusted under 35 U.S.C. 154(b) by 0 days.

(21) Appl. No.: 16/434,045

(22) Filed: Jun. 6, 2019

(65) Prior Publication Data

US 2019/0379955 A1 Dec. 12, 2019

Related U.S. Application Data

(60) Provisional application No. 62/682,706, filed on Jun. 8, 2018.

(51) Int. Cl.

| | |
|---|---|
| ***H04R 19/04*** | (2006.01) |
| ***H04R 1/02*** | (2006.01) |
| ***H04R 1/34*** | (2006.01) |
| ***H04R 1/38*** | (2006.01) |
| ***H04R 19/00*** | (2006.01) |
| ***H04R 1/08*** | (2006.01) |

(52) U.S. Cl.

CPC ..... *H04R 1/02* (2013.01); *H04R 1/08* (2013.01); *H04R 1/342* (2013.01); *H04R 1/38* (2013.01); *H04R 19/005* (2013.01); *H04R 19/04* (2013.01); *H04R 2201/003* (2013.01)

(58) Field of Classification Search

CPC . H04R 1/02; H04R 1/08; H04R 1/342; H04R 1/38; H04R 19/04; H04R 25/402; H04R 2201/003; H04R 2410/01; H04R 19/005

USPC ..... 381/355, 356, 357, 358, 360, 369, 174

See application file for complete search history.

(56) References Cited

U.S. PATENT DOCUMENTS

| | | | | |
|---|---|---|---|---|
| 5,226,076 A * | 7/1993 | Baumhauer, Jr. | ..... | H04M 1/19 379/419 |
| 6,151,399 A * | 11/2000 | Killion | ..... | H04R 1/38 381/313 |
| 6,885,751 B2 * | 4/2005 | Pribyl | ..... | H04R 1/38 381/174 |
| 8,824,719 B2 * | 9/2014 | Tanaka | ..... | H04R 1/38 381/355 |

* cited by examiner

*Primary Examiner* — Huyen D Le

(74) *Attorney, Agent, or Firm* — Keith Lutsch, PC

(57) ABSTRACT

MEMS microphone assembly which is formed by the combination of front and rear single piece boots, which are configured to mate, and a MEMS microphone. The front boot includes two ports for receiving sound waves which are provided to ports of the MEMS microphone. The front boot includes two collars to form the ports and which are used to align the MEMS microphone assembly in a housing containing the MEMS microphone assembly. Acoustic tubes transfer the sound waves from the ports to the MEMS microphone. There can be air channels provided with the acoustic tubes to reduce microphonics. The front and rear boots contain recesses to capture the MEMS microphone to simplify alignment and assembly.

16 Claims, 5 Drawing Sheets

Fig. 3B
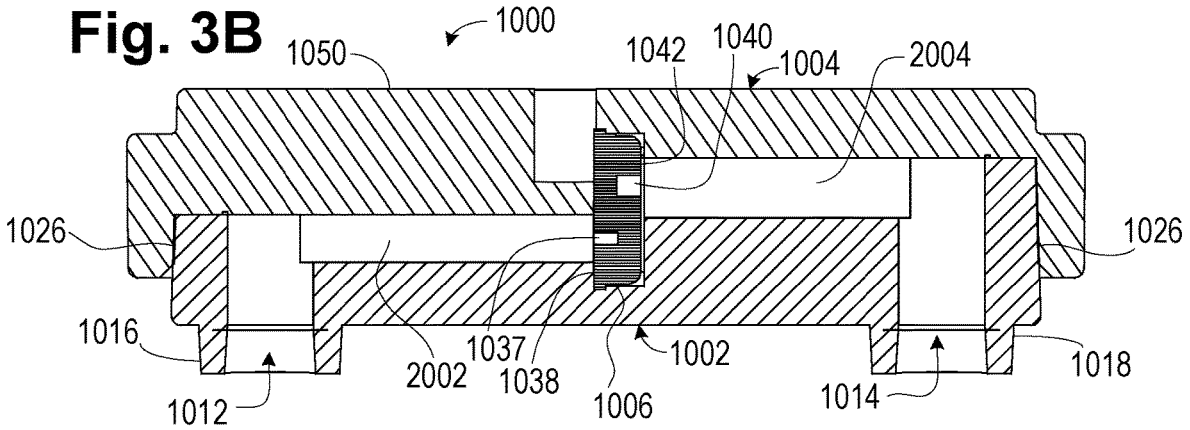
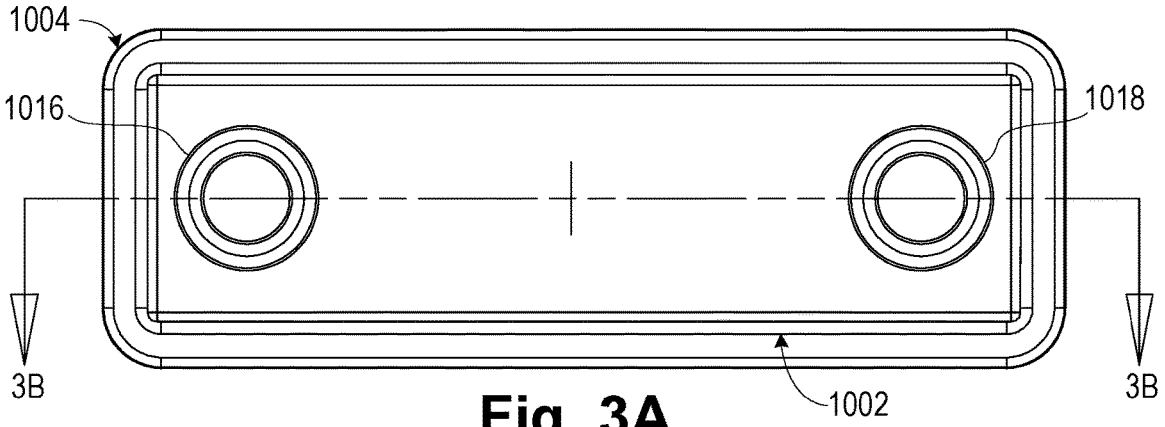
Fig. 3A
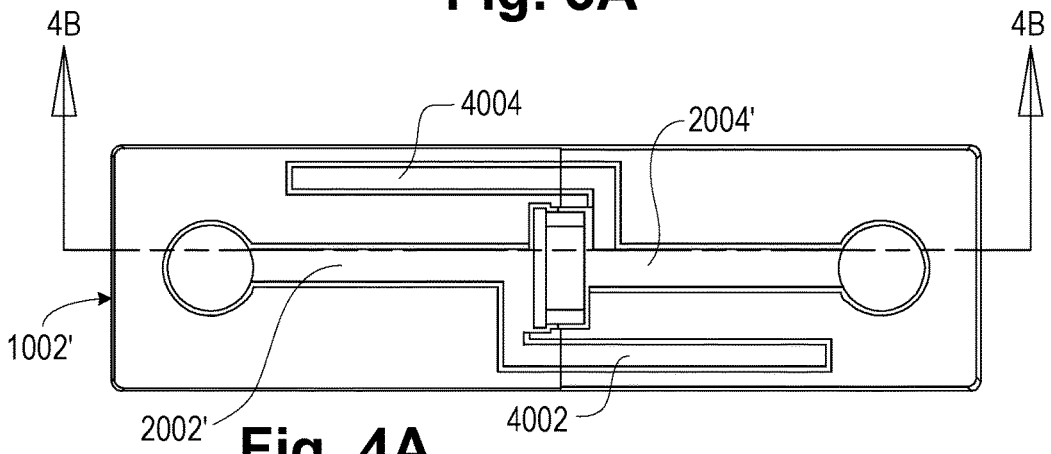
Fig. 4A
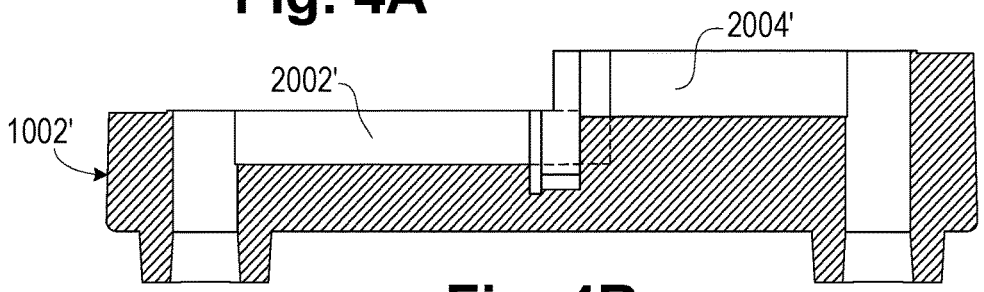
Fig. 4B

GRADIENT MICRO-ELECTRO-MECHANICAL (MEMS) MICROPHONE ASSEMBLY

CROSS-REFERENCE TO RELATED APPLICATIONS

This application claims priority from U.S. Provisional Application No. 62/682,706, filed on Jun. 8, 2018, which is hereby incorporated by reference.

BACKGROUND

U.S. Patent Application Pub. No. 2015/0010191 A1, which is hereby incorporated by reference, discloses a gradient Micro-Electro-Mechanical Systems (MEMS) microphone assembly. The basic MEMS microphone 101 is shown in FIG. 2. The microphone 101 has two ports 111 and 115 for receiving sound waves. When placed in an assembly 100, the acoustic tubes 110 and 114 are used to develop a gradient microphone by having sound waves from separated points operate on both sides of the diaphragm 103 in the microphone 101.

While microphone 101 and the concept of using it for a gradient microphone are an advancement, the particular mounting configurations or assemblies are difficult to make operate correctly in practice. First, the assemblies are difficult to manufacture, requiring many different adhesives and careful alignment of components. Second, attempting to mount the assembly in the manners shown in FIGS. 3A, 3B, 7 and 9 is challenging because of sealing problems between the assembly and the housing, such as housing 202, which causes air leakage, which in turn reduces the quality of the sound being detected.

SUMMARY

According to the present invention, a MEMS microphone assembly is formed by the combination of front and rear single piece boots, which are configured to mate, and a MEMS microphone. The front boot includes two ports for receiving sound waves which are provided to ports of the MEMS microphone. The front boot includes two collars to form the ports and which are used to align the MEMS microphone assembly in a housing containing the MEMS microphone assembly. Acoustic tubes transfer the sound waves from the ports to the MEMS microphone. In some embodiments there are air channels provided with the acoustic tubes to reduce microphonics. The front and rear boots contain recesses to capture the MEMS microphone to simplify alignment and assembly. This configuration allows simple assembly and reduces air leaks and the like compared to the assembly of the U.S. Patent Application Pub. No. 2015/0010191 A1.

BRIEF DESCRIPTION OF THE FIGURES

The accompanying drawings, which are incorporated in and constitute a part of this specification, illustrate an implementation of apparatus and methods consistent with the present invention and, together with the detailed description, serve to explain advantages and principles consistent with the invention.

FIGS. 3A and 3B are various views of the back boot of FIG. 2.

FIGS. 4A and 4B are a second embodiment of the front boot port.

DETAILED DESCRIPTION OF THE PREFERRED EMBODIMENTS

Referring to FIGS. 1, 2A-2D, 3A and 3B, a MEMS microphone assembly woo according to the present invention is illustrated. The MEMS microphone assembly woo has a three-dimensional front boot 1002 and a three-dimensional rear boot 1004, which are configured to mate together and to contain a gradient MEMS microphone 1006, such as the gradient MEMS microphone 100 of U.S. Patent Application Pub. No. 2015/0010191 A1. The MEMS microphone 1006 is generally shaped as a parallelepiped. The rear boot 1004 includes a front side 1028 having a recess 1024 forming a lip 1026 around the rear boot 1004 to receive the front boot 1002. The rear boot 1004 has a back side 1050. Two ports 1012 and 1014 are provided on the front side 1030 of the front boot 1002, port 1012 at a first end 1034 and port 1014 at a second end 1036, to allow sound waves to reach the MEMS microphone 1006. Each port 1012, 1014 includes an acoustic resistance element 1008, 1010 as is conventional. Collars 1016, 1018 form the ports 1012, 1014. The collars 1016, 1018 are preferably formed as part of a single piece forming the front boot 1002. The front boot 1002 and rear boot 1004 include recesses 1022 and 1020, respectively, to align and capture the MEMS microphone 1006 when the front boot 1002 and rear boot 1004 are mated together. The recess 1022 is located in the back side 1032 of the front boot 1002, while the recess 1024 is located in the front side 1028 of the rear boot 1004. This greatly improves the ability to manufacture the MEMS microphone assembly woo, as careful alignment and adhesives as needed in the design of U.S. Patent Application Pub. No. 2015/0010191 A1 are not necessary, the various portions effectively being self-aligning.

If the front boot 1002 and rear boot 1004 are formed of polymeric or plastic materials having a small amount of compressibility and flexibility, the recesses 1022 and 1020 can be sized to snugly receive and hold the MEMS microphone 1006 without the need for adhesives. Similarly, the recess 1024 of the rear boot 1004 can be slightly smaller than the front boot 1002 to snugly receive and hold the front boot 1002 and the rear boot 1004 together without the need for adhesives. To assemble the MEMS microphone assembly woo, the MEMS microphone 1006 is placed in either the front boot 1002 or rear boot 1004 and then the front boot 1002 and the rear boot 1004 are placed together, so that the MEMS microphone 1006 is retained in the proper location and the front boot 1002 and the rear boot 1004 stay together.

If desired, detents or recesses and mating tabs or projections can be formed in and on the front boot 1002 and the rear boot 1004 to provide more positive retention of the elements.

Alternatively, adhesives can be used to affix the MEMS microphone 1006 in place and hold the front boot 1002 to the rear boot 1004.

The front boot 1002 and rear boot 1004 can be formed as single pieces using conventional molding processes or can be 3D printed.

Figure 1:
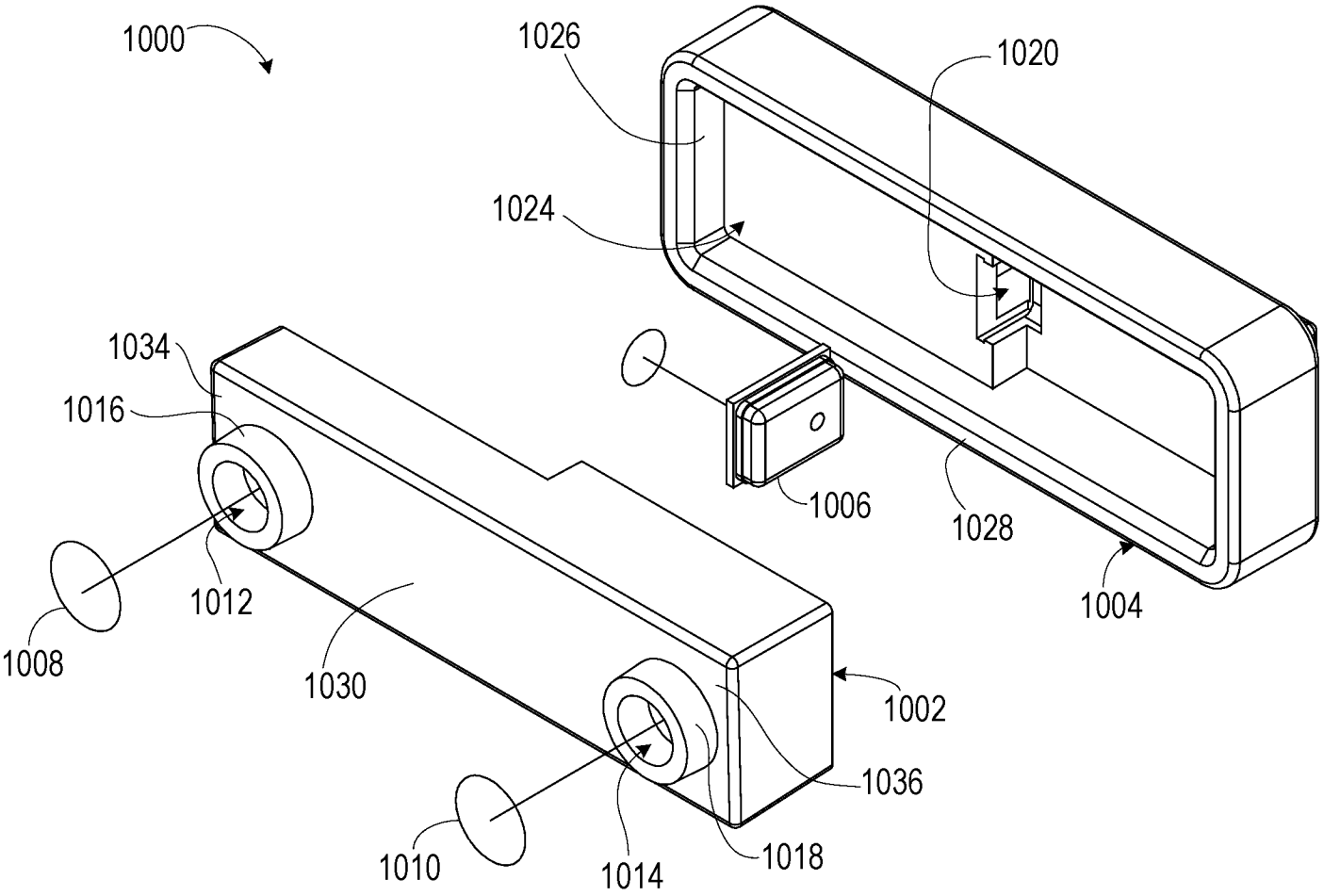
FIG. 1 is an exploded perspective view of a MEMS microphone assembly according to the present invention.
Figure 2B:
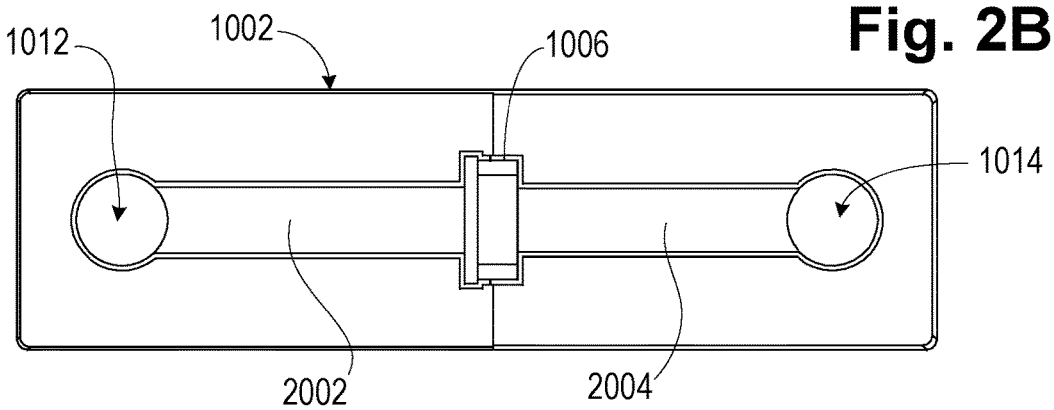
FIGS. 2A-2D are various views of 2 of the front boot port of FIG. 1.
Figure 2A:
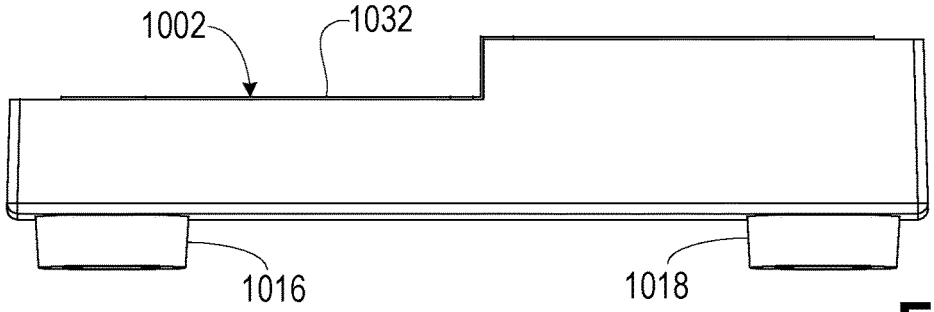

FIGS. 2A-2D are various views of the front boot 1002. FIG. 2A is a side view, illustrating the collars 1016, 1018 and a stepped configuration of the front boot 1002. FIG. 2B is a bottom view, illustrating the ports 1012, 1014 and acoustic tubes 2002, 2004 connecting the ports 1012, 1014 to the MEMS microphone 1006, similar to the acoustic tubes 110 and 114 of U.S. Patent Application Pub. No. 2015/0010191 A1.

Figure 2D:
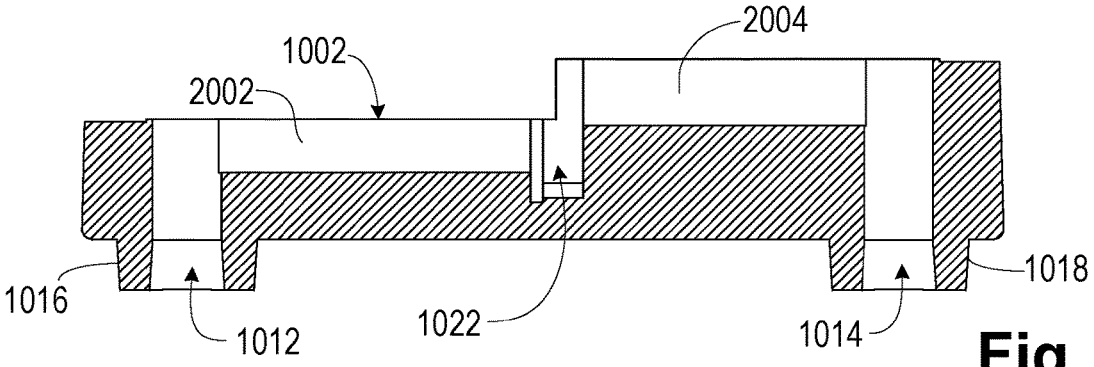
Figure 2C:
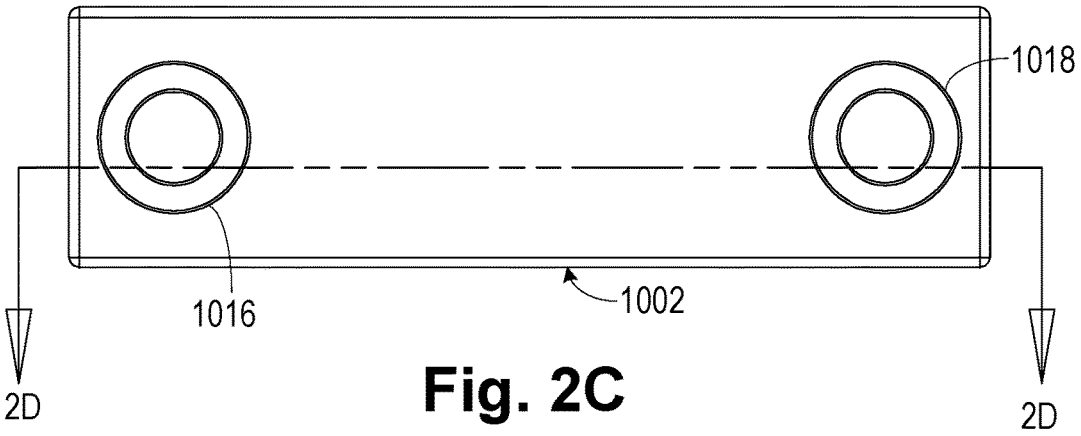

FIG. 2C is a top view of the front boot 1002. FIG. 2D is a cross-sectional view of the front boot 1002, the location of the cross-section being indicated on FIG. 2C. This cross-sectional view provides a side view of the acoustic tubes 2002, 2004.

FIG. 3A is a top view of an assembled MEMS microphone assembly 1000. FIG. 3B is a cross-section of the MEMS microphone assembly 1000 as defined in FIG. 3A. This cross-section includes the MEMS microphone 1006, so the relationship of the acoustic tubes 2002, 2004 to the MEMS microphone 1006 can be seen. The acoustic tube 2002 provides sound waves from the port 1012 to a port 1037 on a first side 1038 of the MEMS microphone 1006. The acoustic tube 2004 provides sound waves from the port 1014 to a port 1040 on a second side 1042 of the MEMS microphone 1006.

FIG. 4A and FIG. 4B show an alternate embodiment for the front boot 1002'. The acoustic tubes 2002' and 2004' are slightly smaller than the acoustic tubes 2002, 2004. Further, air channels 4002 and 4004 have been added to the acoustic tubes 2002', 2004' to reduce the microphonics which may arise with just the simple straight acoustic tubes 2002, 2004.

The Figures show the acoustic tubes 2002, 2004 being formed in the front boot 1002, but they could be located in the rear boot 1004. Additionally, portions of the acoustic tubes 2002, 2004 could be developed in both the front boot 1002 and the rear boot 1004. Further, the air channels 4002, 4004 could be formed in the rear boot 1004, even if the acoustic tubes 2002, 2004 are in the front boot 1002 or the air channels 4002, 4004 could be formed by the combination of the front boot 1002 and the rear boot 1004. The rear boot 1004 preferably is a rigid structure that reduces modulation of the air channel that causes unintended microphonics.

Figure 5A:
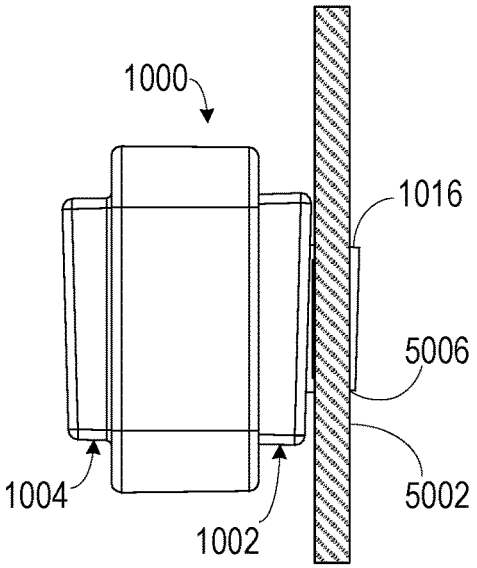
FIGS. 5A and 5B are side views of the MEMS microphone assembly of FIG. 1 installed to a housing.
Figure 5B:
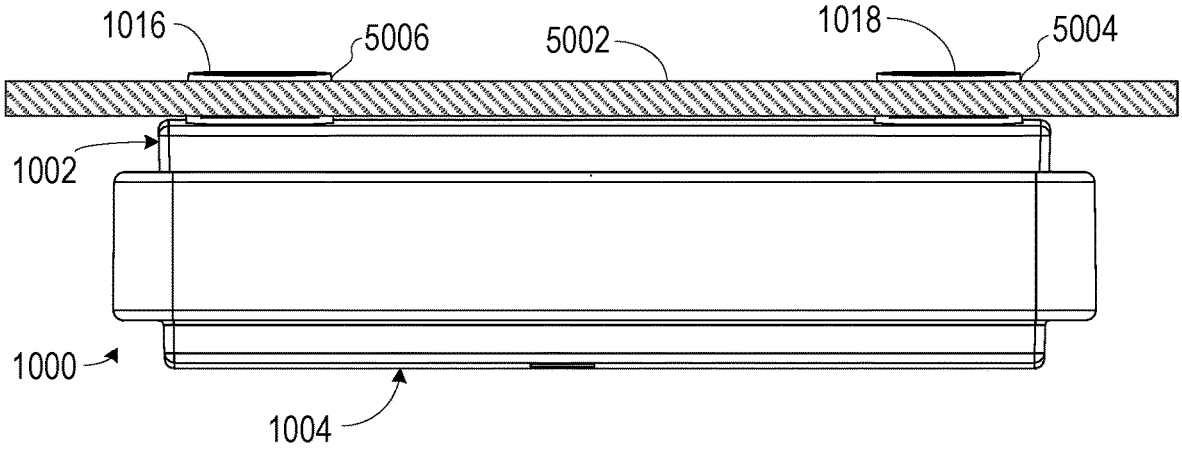

FIGS. 5A and 5B provide side views of the MEMS microphone assembly woo mounted to a housing 5002. The housing 5002 has holes 5004, 5006 which align with the collars 1016, 1018. The collars 1016, 1018 are shown protruding from the housing 5002 for illustrative purpose, but could also be flush or slightly recessed. Because the collars 1016, 1018 are formed with the front boot 1002, there is not the leakage problem associated with the design of U.S. Patent Application Pub. No. 2015/0010191 A1, where two sets of holes in flat elements had to be aligned and sealed, which often resulted in air leakage, as discussed above. In addition, the collars 1016, 1018 provide a simple way of assembling the MEMS microphone assembly woo to the housing 5002 as the collars 1016, 1018 simply mate with and are aligned by the holes in the housing 5002. If the front boot 1002 is formed of a polymeric or plastic material having a small amount of compressibility and flexibility, the collars 1016, 1018 can be snugly received and held in the holes 5004, 5006, eliminating the need for adhesive if desired. In the preferred embodiment an adhesive between the MEMS microphone assembly woo and the housing 5002 is preferred because of potential forces placed on the collars 1016, 1018.

Figure 6:
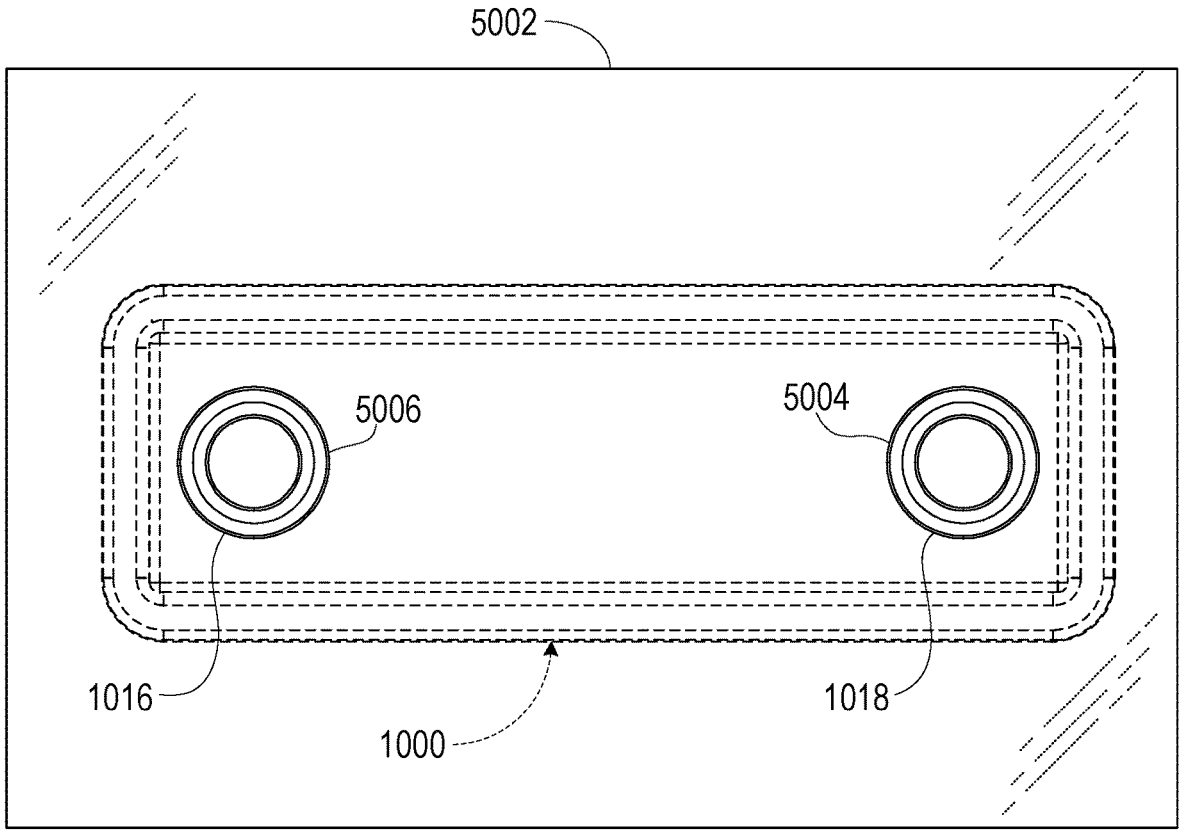
FIG. 6 is a front view of the MEMS microphone assembly of FIG. 1 installed to a housing.

FIG. 6 is a front view of the MEMS microphone assembly woo mounted to the housing 5002.

By having mating front and rear boots which include recesses for receiving a MEMS microphone, the MEMS microphone assembly can be easily assembled and have reduced air leakages. Having projecting collars from the front boot, alignment with a housing is simplified and further air leakage is reduced.

The above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A micro-electro-mechanical systems (MEMS) microphone mounting assembly for use with a MEMS microphone, the MEMS microphone having first and second portions, the first and second portions constituting the MEMS microphone, the MEMS microphone mounting assembly comprising:

a three-dimensional front boot having a front side and a back side, the front side containing two ports for receiving sound waves, the back side containing a recess for receiving the first portion of the MEMS microphone; and a three-dimensional rear boot having a front side and a back side, the front side configured to mate with the back side of the front boot and containing a recess for receiving the second portion of the MEMS microphone, wherein when mated, the front boot and the rear boot form a seal and cooperate to capture the MEMS microphone, and wherein two acoustic tubes in acoustic communication with the two ports are formed in the front boot, the rear boot or both to carry sound waves from the two ports to the recesses for the MEMS microphone.

2. The MEMS microphone mounting assembly of claim 1, wherein the front side of the front boot includes a collar for each port and extending from the front boot.

3. The MEMS microphone mounting assembly of claim 2, wherein the collars are configured for mating with holes in a housing to which the MEMS microphone mounting assembly is to be mounted.

4. The MEMS microphone mounting assembly of claim 1, wherein two air channels in acoustic communication with the two acoustic tubes are formed in the front boot, the rear boot or both.

5. The MEMS microphone mounting assembly of claim 4, wherein the two acoustic tubes and the two air channels are formed in the front boot.

6. The MEMS microphone mounting assembly of claim 1, wherein the two acoustic tubes are formed in the front boot.

7. The MEMS microphone mounting assembly of claim 1, wherein the front side of the rear boot contains a recess forming a lip and is sized to accept the back side of the front boot.

8. The MEMS microphone mounting assembly of claim 1, wherein the front side of the front boot has two ends, wherein a port is located at each end, wherein the recess for receiving the MEMS microphone is located between the two ends, wherein the two acoustic tubes are formed in the front boot, and wherein, for each acoustic tube, the acoustic tube reaches from a respective port to the recess for the MEMS microphone.

9. A micro-electro-mechanical systems (MEMS) microphone assembly comprising:

a gradient MEMS microphone having first and second portions, the first and second portions constituting the MEMS microphone;

a three-dimensional front boot having a front side and a back side, the front side containing two ports for receiving sound waves, the back side containing a recess for receiving the first portion of the MEMS microphone; and a three-dimensional rear boot having a front side and a back side, the front side configured to mate with the back side of the front boot and containing a recess for receiving the second portion of the MEMS microphone, wherein when mated, the front boot and the rear boot form a seal and capture the MEMS microphone, and wherein two acoustic tubes in acoustic communication with the two ports are formed in the front boot, the rear boot or both to carry sound waves from the two ports to the recesses for the MEMS microphone.

10. The MEMS microphone assembly of claim 9, wherein the front side of the front boot includes a collar for each port and extending from the front boot.

11. The MEMS microphone assembly of claim 10, wherein the collars are configured for mating with holes in a housing to which the MEMS microphone mounting assembly is to be mounted.

12. The MEMS microphone assembly of claim 9, wherein two air channels in communication with the two acoustic tubes are formed in the front boot, the rear boot or both.

13. The MEMS microphone assembly of claim 12, wherein the two acoustic tubes and the two air channels are formed in the front boot.

14. The MEMS microphone assembly of claim 9, wherein the two acoustic tubes are formed in the front boot.

15. The MEMS microphone assembly of claim 9, wherein the front side of the rear boot contains a recess forming a lip and is sized to accept the back side of the front boot.

16. The MEMS microphone assembly of claim 9, wherein the front side of the front boot has two ends, wherein a port is located at each end, wherein the recess for receiving the MEMS microphone is located between the two ends, wherein the two acoustic tubes are formed in the front boot, wherein the MEMS microphone is generally a parallelepiped having two opposing faces, each opposing face including a port, and wherein, for each acoustic tube, the acoustic tube reaches from a respective port to a port of the MEMS microphone.

* * * * *